United States Patent [19]

Landa et al.

[11] Patent Number: 4,945,387

[45] Date of Patent: Jul. 31, 1990

[54] IMAGE TRANSFER APPARATUS AND METHOD USING TENSION TRANSFER MEMBER

[75] Inventors: Benzion Landa, Edmonton, Canada; Shabtai Ezuz, Moshav Beit Hannan, Israel; Aron Shmaiser, Rishon-Le-Zion, Israel; Hanna Pinhas, Holon, Israel; Ishaiau Lior, Nes Ziona, Israel

[73] Assignee: Spectrum Sciences B.V., Wassenaar, Netherlands

[21] Appl. No.: 269,710

[22] Filed: Nov. 10, 1988

[30] Foreign Application Priority Data

Oct. 4, 1988 [GB] United Kingdom ..... 8823259

[51] Int. Cl.[5] ..... G03G 15/14

[52] U.S. Cl. ..... 355/271; 355/77; 355/277; 430/126

[58] Field of Search ..... 355/271, 272, 273, 274, 355/275, 277, 281, 212, 213, 300, 309, 310, 256, 77, 132; 430/126

[56] References Cited

U.S. PATENT DOCUMENTS

| | | | |
|---|---|---|---|
| 3,584,861 | 6/1971 | MacDonald | 269/154 |
| 3,868,899 | 3/1975 | Nye et al. | 101/35 |
| 3,907,423 | 9/1975 | Hayashi et al. | 355/10 |
| 3,924,945 | 12/1975 | Weigl | 355/271 X |
| 3,927,934 | 12/1975 | Cook | 355/271 |
| 4,015,027 | 3/1977 | Buchan et al. | 427/22 |
| 4,024,814 | 5/1977 | Becker | 101/410 |
| 4,057,339 | 11/1977 | Miyamoto et al. | 355/271 X |
| 4,351,601 | 9/1982 | Cormier et al. | 355/3 SH |
| 4,392,738 | 7/1983 | Fujino et al. | 355/271 |
| 4,408,863 | 10/1983 | Ogata et al. | 355/271 |
| 4,410,263 | 10/1983 | Gustafson et al. | 355/3 TR |
| 4,411,512 | 10/1983 | Springer | 355/271 |
| 4,482,240 | 11/1984 | Kuge et al. | 355/271 X |
| 4,498,758 | 2/1985 | Nelen | 355/3 TR |
| 4,541,709 | 9/1985 | Kampschreur | 355/271 X |
| 4,571,864 | 2/1986 | Bopp | 38/102.5 |

FOREIGN PATENT DOCUMENTS

| | | |
|---|---|---|
| 0089080 | 9/1983 | European Pat. Off. . |
| 2656881 | 6/1977 | Fed. Rep. of Germany . |
| 538316 | 7/1941 | United Kingdom . |
| 640103 | 7/1950 | United Kingdom . |
| 723743 | 2/1955 | United Kingdom . |
| 929031 | 6/1963 | United Kingdom . |
| 1182696 | 3/1970 | United Kingdom . |
| 1457822 | 12/1976 | United Kingdom . |
| 1522259 | 8/1978 | United Kingdom . |
| 2084965 | 4/1982 | United Kingdom . |
| 2169416 | 7/1986 | United Kingdom . |
| 2176904 | 1/1987 | United Kingdom . |

OTHER PUBLICATIONS

British Search Report for British Application No. 8823259.0.

International Search Report, PCT/NL89/00074.

*Primary Examiner*—A. C. Prescott

*Attorney, Agent, or Firm*—Sandler, Greenblum & Bernstein

[57] ABSTRACT

Imaging apparatus including a flexible substrate, apparatus for tensioning the flexible substrate in at least two directions and apparatus for bringing the tensioned flexible substrate into image transfer engagement with an image bearing surface. A method of imaging using the apparatus is also described.

52 Claims, 16 Drawing Sheets

FIG. 3
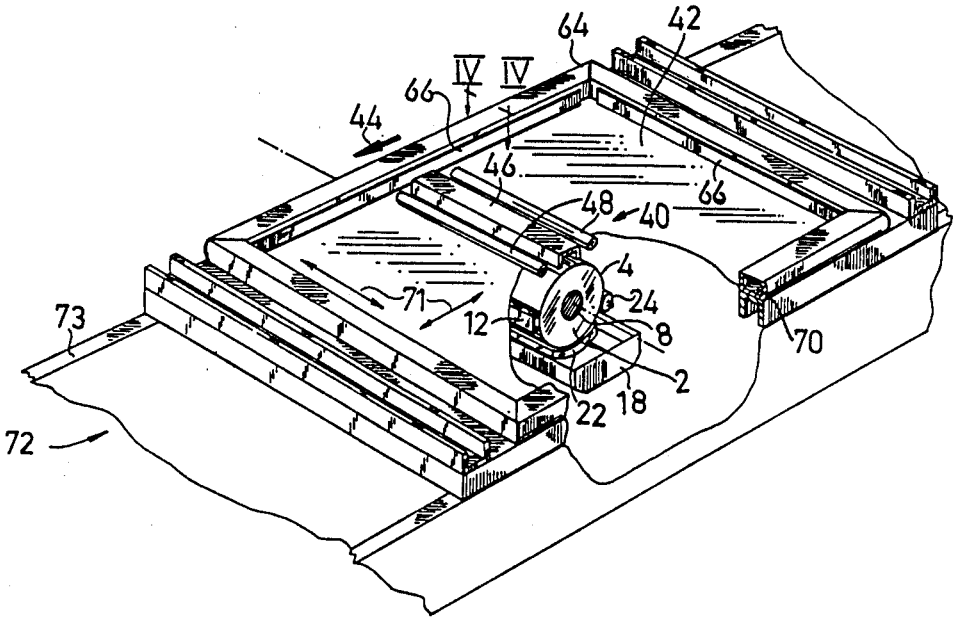
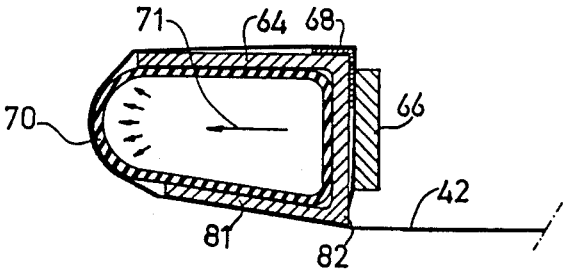
FIG. 4

IMAGE TRANSFER APPARATUS AND METHOD USING TENSION TRANSFER MEMBER

FIELD OF THE INVENTION

The present invention relates generally to imaging and more particularly to the use of tensioned substrates in image transfer.

BACKGROUND OF THE INVENTION

In electrostatic image transfer a toner or ink image defined on an image support surface is transferred electrostatically to a substrate. It may be fixed on that substrate, or alternatively transferred to a further substrate which is the intended image carrier.

In conventional electrostatic copiers, a developed image is transferred to loosely held paper by electrostatic and adhesion forces. The loosely held paper is brought into contact with the image as it is simultaneously charged to a high voltage. This technique, which is adequate for medium quality photocopying is unsuitable for more exacting processes, such as color proofing, for two principle reasons: loose mounting of the paper makes registration of one image with another difficult, and mottle results from topographical variations in the loosely held paper surface. Such variations result in variation in the pressure of the paper on a wet image, which result in variations in dot size. The variations in dot size translate into low frequency grey-level variations, here referred to as "mottle".

The use of tensioned substrates in electrostatic image transfer is known in the literature. U.S. Pat. No. 4,015,027 describes an electrophotographic toner transfer and fusing method which employs a tensioned transfer belt for transferring a toner image from a photoconductive drum or a photoconductive insulating sheet onto paper.

In the embodiment of U.S. Pat. No. 4,015,027, the transfer belt is tensioned only along the direction of its travel. Such tensioning tends to produce surface irregularities in the belt along directions transverse to the direction of travel. As a result the uniformity of transfer is adversely affected, lowering the general level of image quality produced by the apparatus due to mottle and rendering the transfer technique incompatible with registration requirements as for multi-color operations.

SUMMARY OF THE INVENTION

It is an aim of the invention to provide apparatus and a method of use thereof, for use in image transfer, so as to overcome the limitations of the prior art.

In accordance with a preferred embodiment of the invention there is provided imaging apparatus comprising a flexible substrate, apparatus for tensioning the flexible substrate in at least two directions and apparatus for bringing the tensioned flexible substrate into image transfer engagement with an image bearing surface.

Further in accordance with a preferred embodiment of the invention, the imaging apparatus also comprises apparatus for subsequently bringing the tensioned flexible substrate bearing an image into image transfer engagement with an image receiving surface.

In accordance with one embodiment of the invention, the apparatus for bringing the tensioned flexible substrate into image transfer engagement produces motion of the flexible substrate and the image bearing surface in a travel direction and the at least two directions of tensioning include the travel direction and a direction transverse thereto in the plane along which the flexible substrate lies when in image transfer engagement.

In accordance with an embodiment of the invention, the image bearing surface is a gravure cylinder. In accordance with another embodiment of the invention, the image bearing surface is a photoconductive surface.

In accordance with an embodiment of the invention, the image comprises charged particles and apparatus is provided for generating an electrical field in the region where image transfer engagement occurs to facilitate image transfer.

Further in accordance with a preferred embodiment of the present invention, the apparatus for tensioning is operative for supporting the flexible substrate in a generally planar orientation and contacts the flexible substrate only outside the regions of image transfer engagement.

Additionally in accordance with a preferred embodiment of the invention, the apparatus for bringing the tensioned flexible substrate into image transfer engagement with an image bearing surface includes apparatus for providing synchronized motion of the image bearing surface and of the flexible substrate in image transfer engagement therewith to prevent relative sliding motion therebetween.

In accordance with a preferred embodiment of the invention, the image bearing surface comprises a generally cylindrical surface and the apparatus for tensioning is operative for supporting the flexible substrate in a generally planar orientation, in generally tangential orientation relative to the generally cylindrical surface during image transfer engagement.

In accordance with an embodiment of the invention, the flexible surface is in generally curved surface contact with a portion of the cylindrical image bearing surface during image transfer engagement.

Additionally in accordance with a preferred embodiment of the invention, the apparatus for tensioning comprises a frame having an expandable element associated therewith along its periphery, whereby expansion of the expandable element provides tensioning of a flexible substrate mounted on the frame in at least two directions.

Further in accordance with an embodiment of the invention, the apparatus for tensioning comprises pressure rollers engaging the flexible substrate so as to apply pressure thereto during image transfer engagement.

In accordance with one embodiment of the invention, the image receiving surface comprises a curved surface, such as a cylinder. Alternatively the image receiving surface comprises a non-cylindrical surface, whose cross section varies smoothly in a direction transverse to the direction of travel between the flexible substrate and the image receiving surface.

Where the image receiving surface comprises a cylinder, it may be a circular cylinder or alternatively a non-circular cylinder, such as an elliptical cylinder. When the cylinder has a non-circular cross section, the apparatus for subsequently bringing the tensioned flexible substrate bearing an image into image transfer engagement with the image receiving surface preferably comprises spring loaded means for rotatably mounting the image receiving surface.

Additionally in accordance with a preferred embodiment of the present invention there is provided a method for transfer of images from an image bearing surface onto a flexible substrate comprising the steps of tensioning the flexible substrate in at least two directions and bringing the tensioned flexible substrate into image transfer engagement with an image bearing surface.

Further in accordance with a preferred embodiment of the invention, the method also comprises the step of subsequently bringing the tensioned flexible substrate bearing an image into image transfer engagement with an image receiving surface.

In accordance with one embodiment of the invention, the step of bringing the tensioned flexible substrate into image transfer engagement includes the step of producing motion of the flexible substrate and the image bearing surface in a travel direction, and the step of tensioning in at least two directions of tensioning includes the step of tensioning the flexible substrate in the travel direction and a direction transverse thereto in the plane along which the flexible substrate lies when in image transfer engagement.

In accordance with an embodiment of the invention wherein the image comprises charged particles, the method also comprises the step of generating an electrical field in the region where image transfer engagement occurs to facilitate image transfer.

Further in accordance with a preferred embodiment of the present invention, the step of tensioning is operative for supporting the flexible substrate in a generally planar orientation and contacting the flexible substrate only outside the region of image transfer engagement.

Additionally in accordance with a preferred embodiment of the invention, the step of bringing the tensioned flexible substrate into image transfer engagement with an image bearing surface includes the step of providing synchronized motion of the image bearing surface and of the flexible substrate in image transfer engagement therewith to prevent relative sliding motion therebetween.

In accordance with a preferred embodiment of the invention wherein the image bearing surface comprises a generally cylindrical surface, the step of tensioning is operative for supporting the flexible substrate in a generally planar orientation, in generally tagential orientation relative to the generally cylindrical surface during image transfer engagement.

Additionally in accordance with a preferred embodiment of the invention, the step of tensioning comprises the steps of mounting the flexible substrate on a frame having an expandable element associated therewith along its periphery, and expanding the expandable element to provide tensioning of a flexible substrate mounted on the frame in at least two directions.

BRIEF DESCRIPTION OF THE DRAWINGS

The present invention will be understood and appreciated more fully from the following detailed description, taken in conjunction with the drawings, in which:

FIG. 3 is a partial perspective pictorial illustration of the apparatus shown in FIG. 1;

FIG. 4 is a cross-sectional view taken along line IV—IV in FIG. 3;

DETAILED DESCRIPTION OF THE INVENTION

Figure 1A:
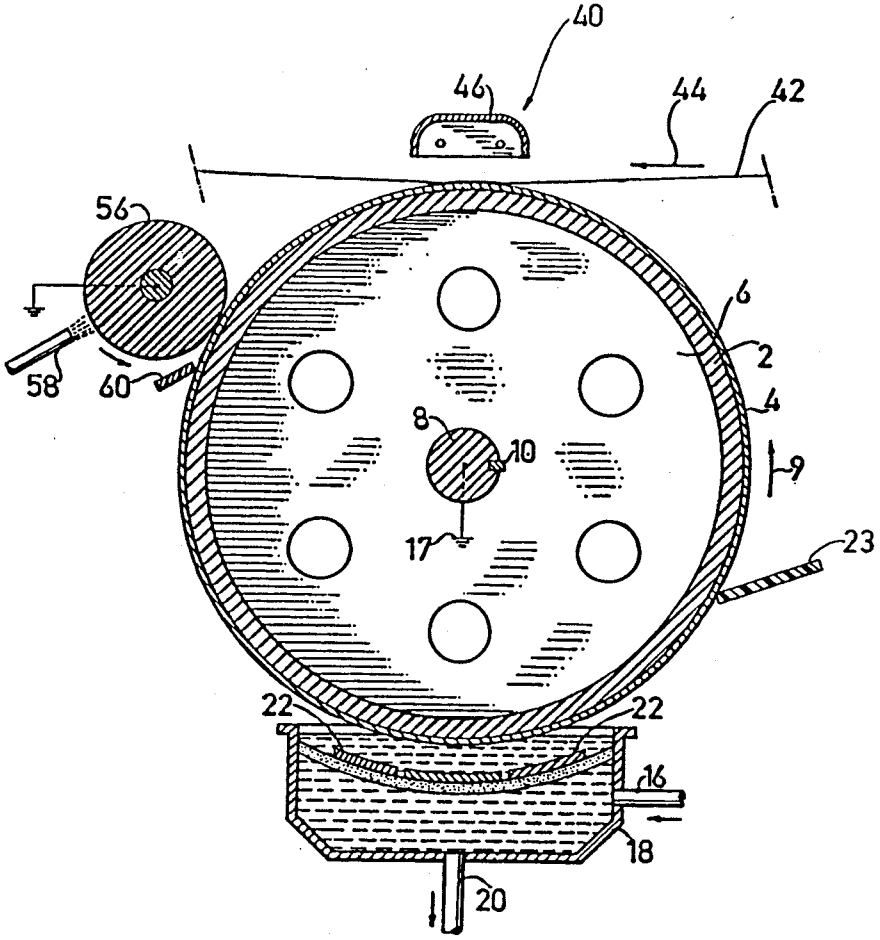
FIGS. 1A, 1B and 1C each illustrate, in schematic form, image transfer apparatus constructed and operative in accordance with a preferred embodiment of the present invention in three respective versions.
Figure 1B:
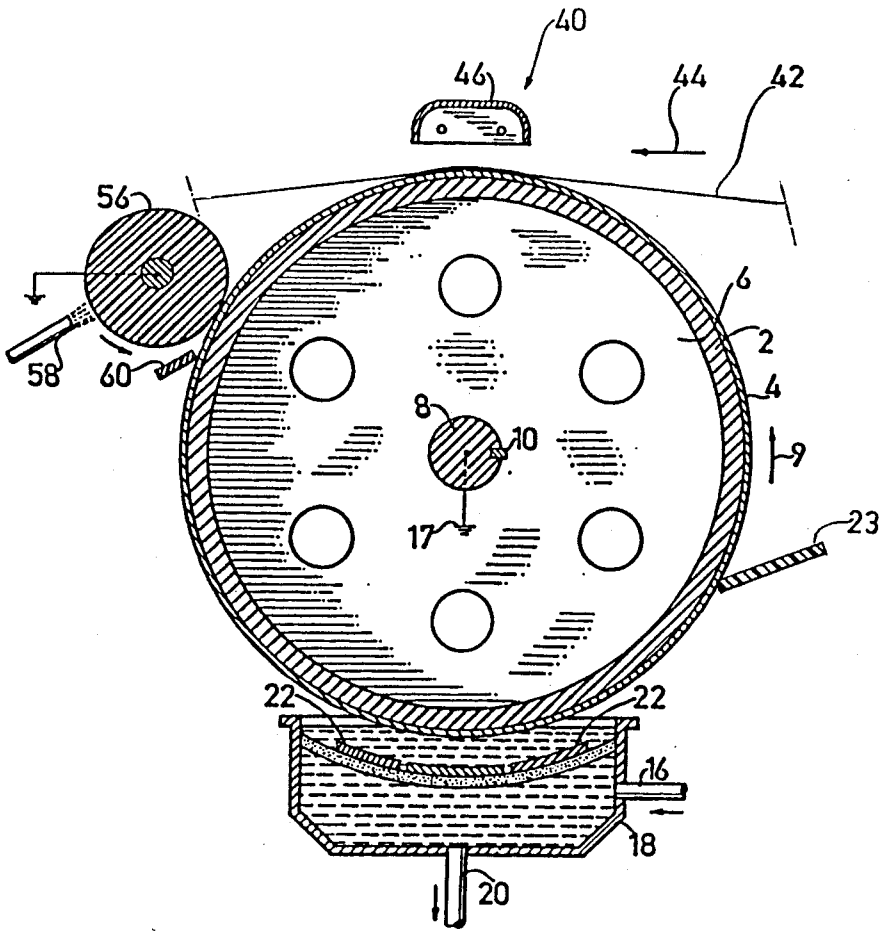
Figure 1C:
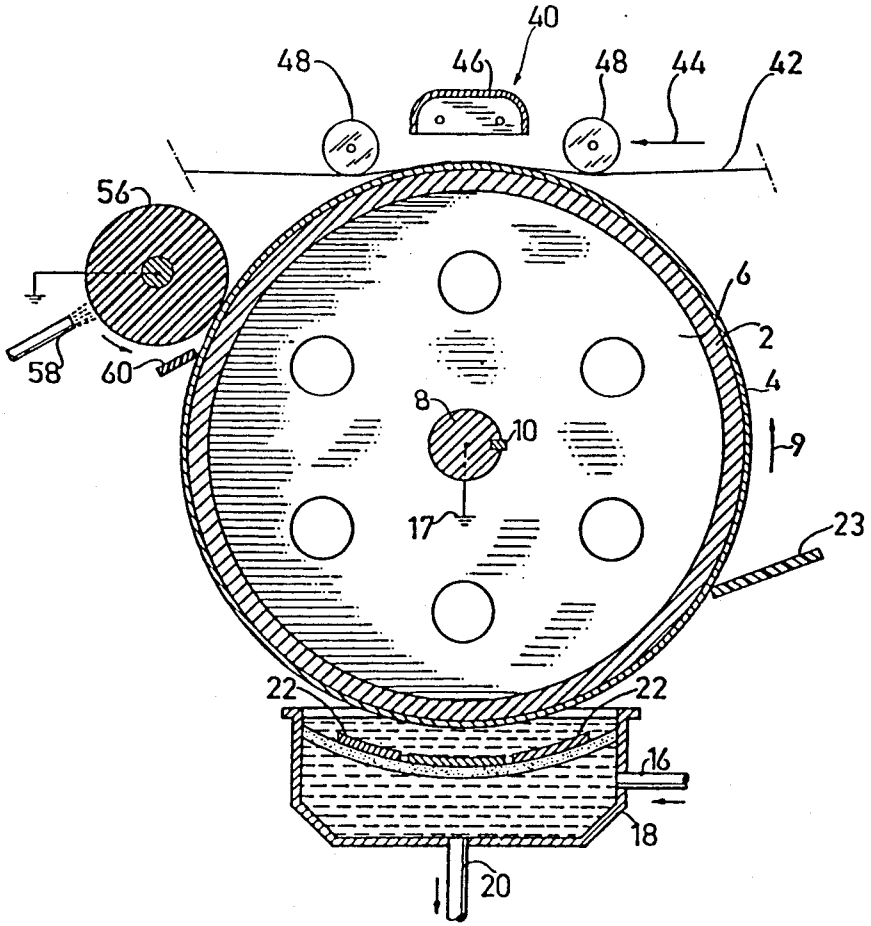

Reference is now made to FIGS. 1A–1C which illustrate, in schematic form, three variations of image transfer apparatus constructed and operative in accordance with a preferred embodiment of the present invention. For simplicity and conciseness, the common features of all three variations will be described initially, followed by an explanation of the differences therebetween.

There is thus shown a metal drum 2 onto which is mounted an image bearing surface here embodied in a cylindrical gravure printing plate 4 bearing an engraved image. The drum 2 typically comprises end disks 6 which are mounted onto a shaft 8 by a key 10 so that the assembly is operative to rotate together with shaft 8. Shaft 8 is driven in any appropriate manner (not shown) in the direction of an arrow 9. Shaft 8, and the entire drum 2 and plate 4, are grounded, by a connection indicated by reference numeral 17.

An image defining material, such as a liquid toner, which normally contains a dispersion of polymer-supported pigmented particles with added charge director in an insulating, nonpolar, nontoxic liquid, is circulated from any suitable source (not shown) through a pipe 16 into a development tray 18 from which it is drawn through a pipe 20 for recirculation.

A preferred image defining material is described in the examples in Published Applications GB No. 2169416A and GB No. 2176904A, the disclosures of which are incorporated herein by reference. Alternatively, any other suitable image defining material, such as toner or printing ink, may be employed.

Development electrodes 22, which may be appropriately biased as known to the art, assist in toning the electrostatic latent image as it passes into contact with the developing liquid. Charged toner particles suspended in the developing liquid pass by electrophoresis to the gravure plate 4 and cover the entire surface. A scraper 23 removes the material from the non-image areas.

Once the excess image defining material has been removed, the image is ready for transfer onto a flexible substrate, such as a sheet of paper, single or double coated chroma paper, a material suitable for silk screening, a material such as POLYMON, commercially available from Swiss Silk Bolting Cloth Manufacturing Co. Ltd. of Zurich, Switzerland under part number PES-1/1SRC, or a plastic sheet, and is rotationally conveyed towards a transfer station, referenced generally 40.

With additional reference to FIGS. 3 and 4, the flexible substrate 42 is maintained under tension in at least two directions and is conveyed generally tangentially along cylindrical plate 4, in a direction shown by an arrow 44, which is preferably one of the directions along which the substrate is tensioned. As will be explained below, it is an important feature of the present invention that there is provided synchronized drive apparatus to synchronize relative motion between plate 4 and substrate 42. The structure and operation of one such synchronized drive apparatus is described below with reference to FIGS. 5A–8.

In electrostatic image transfer, using the preferred image defining material described in the examples in Published Applications GB No. 2169416A and GB No. 2176904A, for example, at transfer station 40, a corona discharge device 46 impresses upon the rear of substrate 42 a charge of polarity opposite to that of the toner particles forming the image. Constituent particles of the image are thus drawn towards substrate 42. As seen in the drawings, due to electrostatic forces the substrate 42 tends to be drawn to and conform to the curved configuration of the cylindrical plate 4.

A cleaning roller 56, formed of any appropriate synthetic resin, is driven in a direction opposite to that of the plate to scrub clean its surface. To assist in this action, a suitable cleaning liquid may be fed through a pipe 58 to the surface of cleaning roller 56. A wiper blade 60 completes the cleaning of the plate. Alternatively, the cleaning roller 56 and the associated wiper blade 60 may be eliminated.

In the embodiment of FIG. 1A, the tensioned flexible substrate 42 is arranged to define a relatively narrow area of contact with the gravure plate 4 prior to operation of corona discharge device 46. Upon operation of the corona discharge device, the generated electric field causes the flexible substrate to be drawn to the gravure plate 4 and thus to define a broader area of contact, as shown in FIG. 1A. In the embodiment of FIG. 1B, the arrangement is such that the substrate defines a much wider contact with the image bearing surface of gravure plate 4. In the embodiment of FIG. 1C a pair of rollers 48 is also provided so as to enhance contact between substrate 42 and the image bearing surface of the gravure plate 4.

Figure 2A:
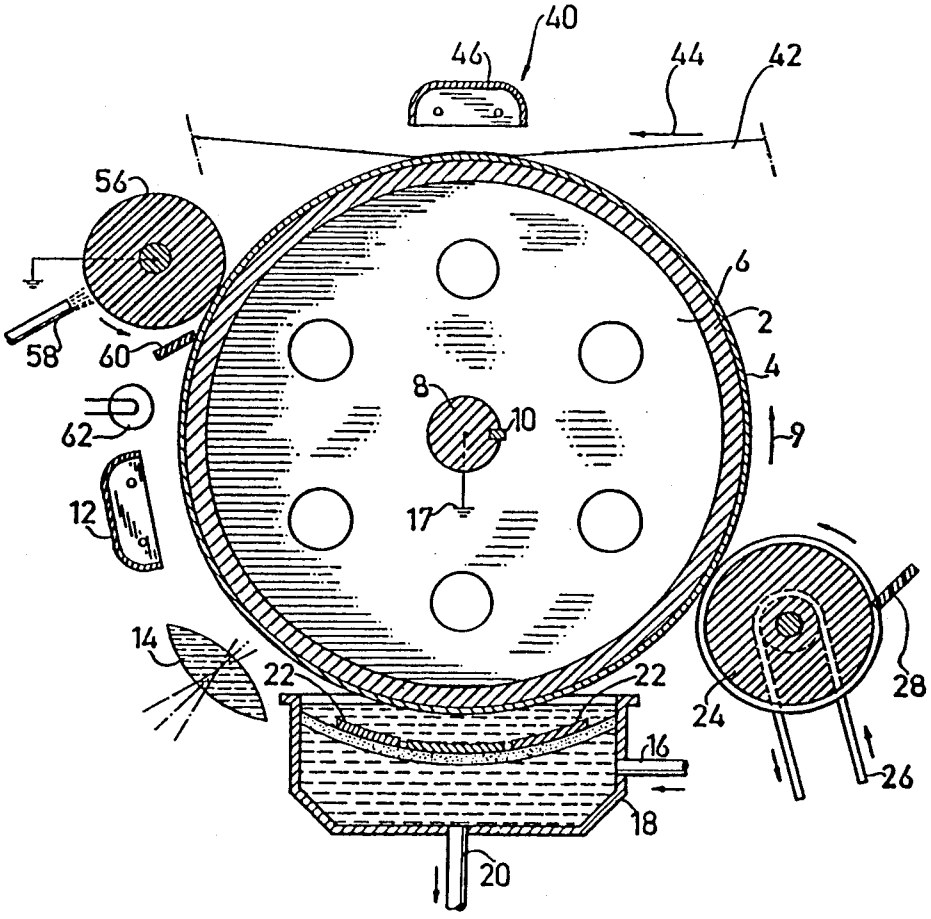
FIGS. 2A, 2B and 2C each illustrate, in schematic form, image transfer apparatus constructed and operative in accordance with another preferred embodiment of the present invention in three respective versions.
Figure 2B:
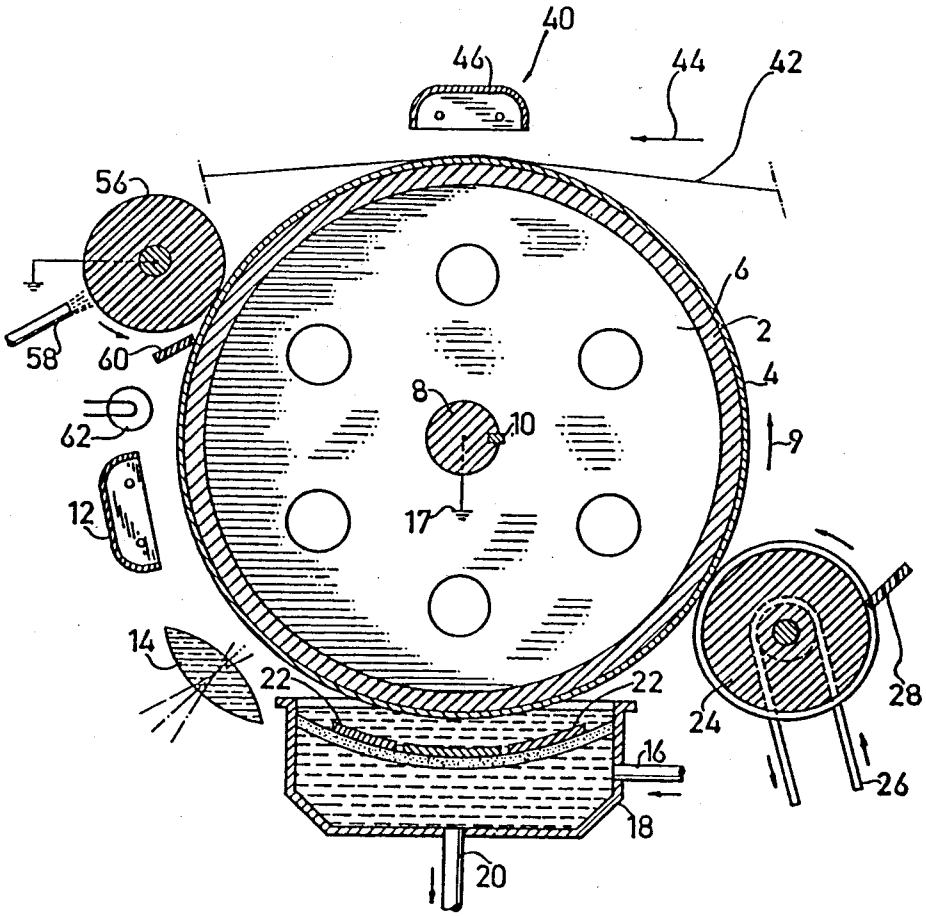
Figure 2C:
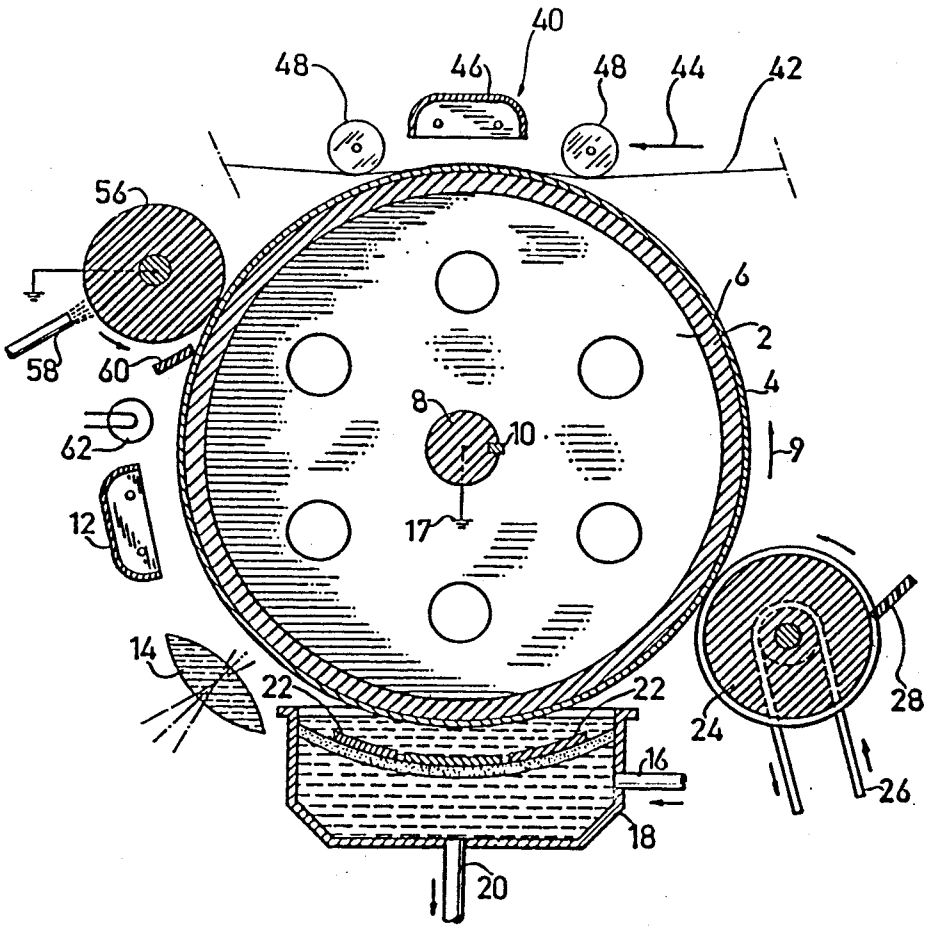

Reference is now made to FIGS. 2A–2C which illustrate, in schematic form, three variations of image transfer apparatus constructed and operative in accordance with another preferred embodiment of the present invention. For simplicity and conciseness, the common features of all three variations will be described initially, followed by a explanation of the differences therebetween.

There is thus shown a metal drum 2 onto which is mounted a cylindrical image bearing surface in the form of a photoconductive surface 4 bearing a latent image.

The drum 2 typically comprises end disks 6 which are mounted onto a shaft 8 by a key 10 so that the assembly is operative to rotate together with shaft 8. Shaft 8 is driven in any appropriate manner (not shown) in the direction of an arrow 9. Shaft 8, and the entire drum 2 and plate 4, are grounded, by a connection indicated by reference numeral 17.

The image to be reproduced is projected by an optical system 14 onto the charged photoconductor. Since shaft 8 is grounded at 17 and disks 6 are conductive, the areas impinged upon by light discharge to ground and the remaining charged areas constitute a latent electrostatic image.

An image defining material such as a liquid toner, which normally contains a dispersion of polymer-supported pigment with added charge director in an insulating, nonpolar, nontoxic liquid, is circulated from any suitable source (not shown) through a pipe 16 into a development tray 18 from which it is drawn through a pipe 20 for recirculation.

A preferred image defining material is described in the examples in Published Applications GB No. 2169416A and GB No. 2176904A, the disclosure of which is incorporated herein by reference. Alternatively, any other suitable image defining material, such as powdered or liquid toner may be employed.

Development electrodes 22, which may be appropriately biased as known to the art, assist in toning the electrostatic latent image as it passes into contact with the developing liquid. Charged toner particles suspended in the developing liquid pass by electrophoresis to the electrostatic latent image. If a selenium photoconductor is used and is, for example, positively charged, in a method of positive development, the pigment particles are negatively charged. In a method of reverse development, however, the pigment particles are positively charged and, as known in the art, are attracted to those areas of the photoconductor that have been discharged as described above.

Since the amount of liquid on the photoconductor surface is normally too great for satisfactory subsequent transfer of the developed image, a roller 24, whose surface moves in a direction opposite to that of the photoconductor surface is spaced therefrom and is adapted to shear excess liquid from the developed image without disturbing it. An exemplary roller is shown in U.S. Pat. No. 3,907,423, the contents of which are incorporated herein by reference.

Roller 24 is driven by any appropriate means, such as by a drive belt 26 which is driven by any appropriate known speed-controllable motor means (not shown). The roller is kept clean by a wiper blade 28. Once any excess liquid has been removed by roller 24, the developed image is ready for transfer onto a chosen transfer substrate, and is rotationally conveyed towards a transfer station, referenced generally 40.

As noted above in connection with FIGS. 1A–1C, a flexible substrate 42, such as a sheet of paper, single or double coated chroma paper, a material suitable for silk screening, or a material such as POLYMON, commercially available from Swiss Silk Bolting Cloth Manufacturing Co. Ltd. of Zurich, Switzerland under part number PES-1/1/SRC, is maintained under tension in at least two directions and is conveyed generally tangentially along cylindrical plate 4, in a direction shown by an arrow 44, which is preferably one of the directions along which the substrate is tensioned.

As will be explained below, it is an important feature of the present invention that there is provided synchronized drive apparatus to synchronize relative motion between plate 4 and substrate 42. The structure and operation of the synchronized drive apparatus is described below with reference to FIGS. 5A–8.

In electrostatic image transfer, using the preferred image defining material described in the examples in Published Applications GB Nos. 2169416A and 2176904A, for example, at transfer station 40, a corona discharge device 46 impresses upon the rear of substrate 42 a charge of polarity opposite to that of the toner particles forming the image. Constituent particles of the image are thus drawn towards substrate 42. As noted above in connection with FIGS. 1A–1C, the electrostatic forces tend to draw the substrate 42 into shape conforming engagement with the photoconductor 4.

A cleaning roller 56, formed of any appropriate synthetic resin, is driven in a direction opposite to that of the plate to scrub clean its surface. To assist in this action, a suitable cleaning liquid may be fed through a pipe 58 to the surface of cleaning roller 56. A wiper blade 60 completes the cleaning of the plate.

Any residual charge left on the photoconductive drum is extinguished by flooding the photoconductor surface with light from a lamp 62.

In the embodiment of FIG. 2A, the tensioned flexible substrate 42 is arranged to define a relatively narrow area of contact with the photoconductor 4 prior to operation of corona discharge device 46. Upon operation of the corona discharge device, the generated electric field causes the flexible substrate to be drawn to the gravure plate 4 and thus to define a broader area of contact, as shown in FIG. 2A. In the embodiment of FIG. 2B, the arrangement is such that the substrate defines a much wider contact, here termed curved area contact, with the image bearing surface of photoconductor 4. In the embodiment of FIG. 2C a pair of rollers 48 is also provided so as to enhance contact between substrate 42 and the image bearing surface of the photoconductor 4.

Alternatively the photoconductor 4 can be replaced by an electrostatic master such as a master commercially available from DuPont under the tradename EPIC. In such a case, the apparatus of FIGS. 2A–2C is employed with the exception of lens 14 and lamp 62, which are eliminated.

Referring particularly to FIGS. 3 and 4, transfer substrate 42 is mounted under tension on a channel-section frame 64, the open side of the channel facing outwards. Peripheral portions of substrate 42 are wrapped around frame 64, which is made preferably from a material having magnetic properties, and are secured to inward facing portions thereof as by magnetic strips 66.

A bottom surface 81 of frame 64 preferably slopes downwards towards an edge 82 which defines a support plane for substrate 42.

It is to be appreciated that any other suitable method of securing substrate 42 to frame 64 may be employed in an alternative embodiment of the invention. In the illustrated embodiment of the invention, strips, referenced 68, of a high friction medium such as emery cloth are used to further secure substrate 42 to frame 64.

Housed within frame 64, preferably along the entire periphery thereof, is tensioning apparatus which, in a preferred embodiment of the invention, comprises an expansible tube 70, expansion of which applies to substrate 42 an outward, tensioning force in multiple directions as indicated by arrows 71.

When the flexible substrate is tensioned in at least two directions, as by the apparatus shown in FIGS. 3 and 4 and as described in conjunction therewith, surface variations in the substrate surface are substantially reduced and enhanced transfer uniformity is realized, producing reduced mottle. This is due to the substantially uniform pressure at which the tensioned substrate is brought into contact with the image.

Figure 5A:
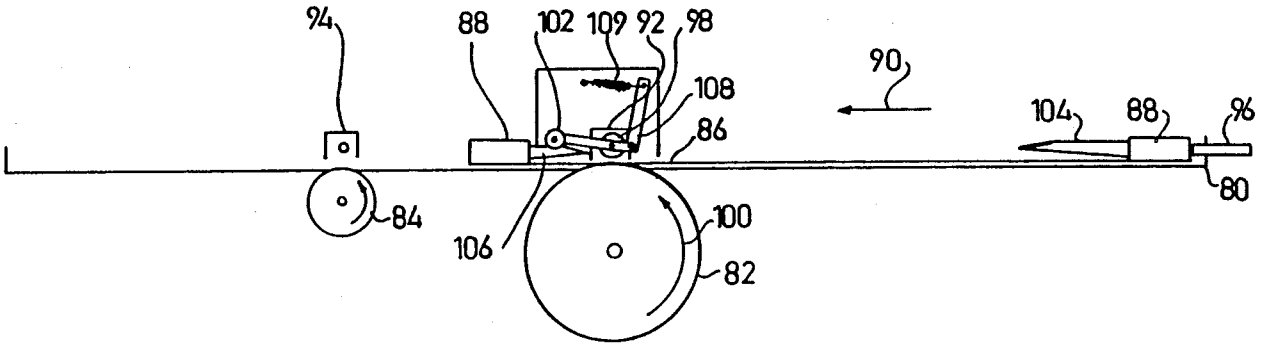
FIGS. 5A, 5B and 5C are schematic side view illustrations of the operation of synchronized drive apparatus employed in accordance with an embodiment of the present invention in respective starting, intermediate and end positions.
Figure 5B:
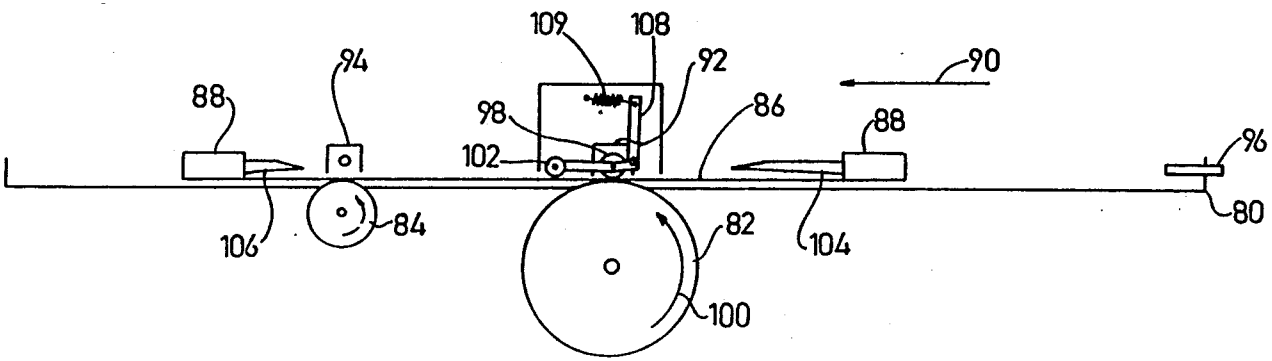
Figure 5C:
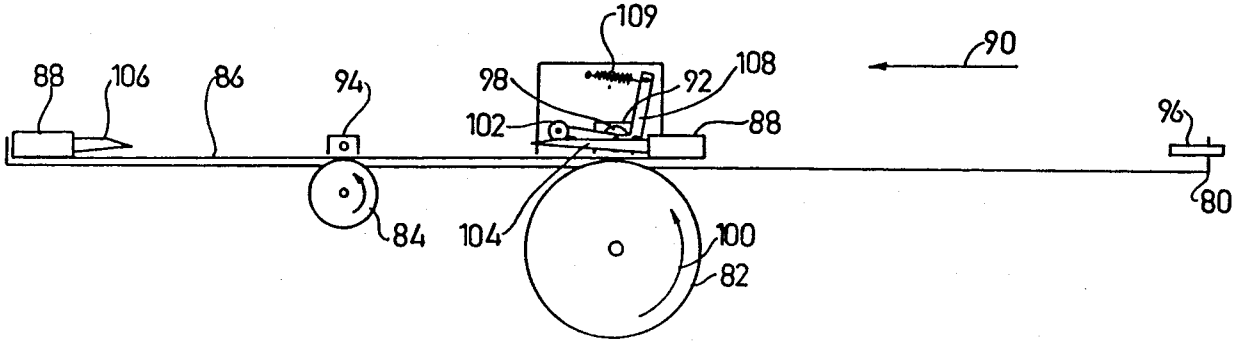

Reference is now made to FIGS. 5A, 5B and 5C, which illustrate image transfer apparatus for transferring an image onto a curved image receiving surface in three different operating orientations. The apparatus comprises a fixed support surface 80. Disposed in predetermined locations with respect to the support surface are an image bearing surface 82, typically in the form of a cylindrical drum of the type described hereinabove in connection with any of FIGS. 1A–2C, and an image receiving surface 84, such as a cylindrical object, for example, a beverage can.

A tensioned flexible transfer substrate 86, typically a sheet of paper, single or double coated chroma paper or a material suitable for silk screening, such as POLYMON, commercially available from Swiss Silk Bolting Cloth Manufacturing Co. Ltd. of Zurich, Switzerland under part number PES-1/1/SRC, supported on a frame 88, such as the frame described in FIGS. 3 and 4, is mounted for relatively unimpeded sliding motion along support surface 80, in a direction indicated by an arrow 90. The arrangement and linear motion of substrate 86 and the rotation of image bearing surface 82 and image receiving surface 84 are such that flexible substrate 86 sequentially engages image bearing surface 82 in image transfer engagement therewith and then engages image receiving surface 84 in image transfer engagement therewith. Corotrons 92 and 94 are positioned in operative engagement with the flexible substrate 86 at the regions of engagement with the image bearing surface 82 and the image receiving surface 84 respectively for providing an appropriate charge to the substrate 86 for enhancing transfer.

Figure 6:
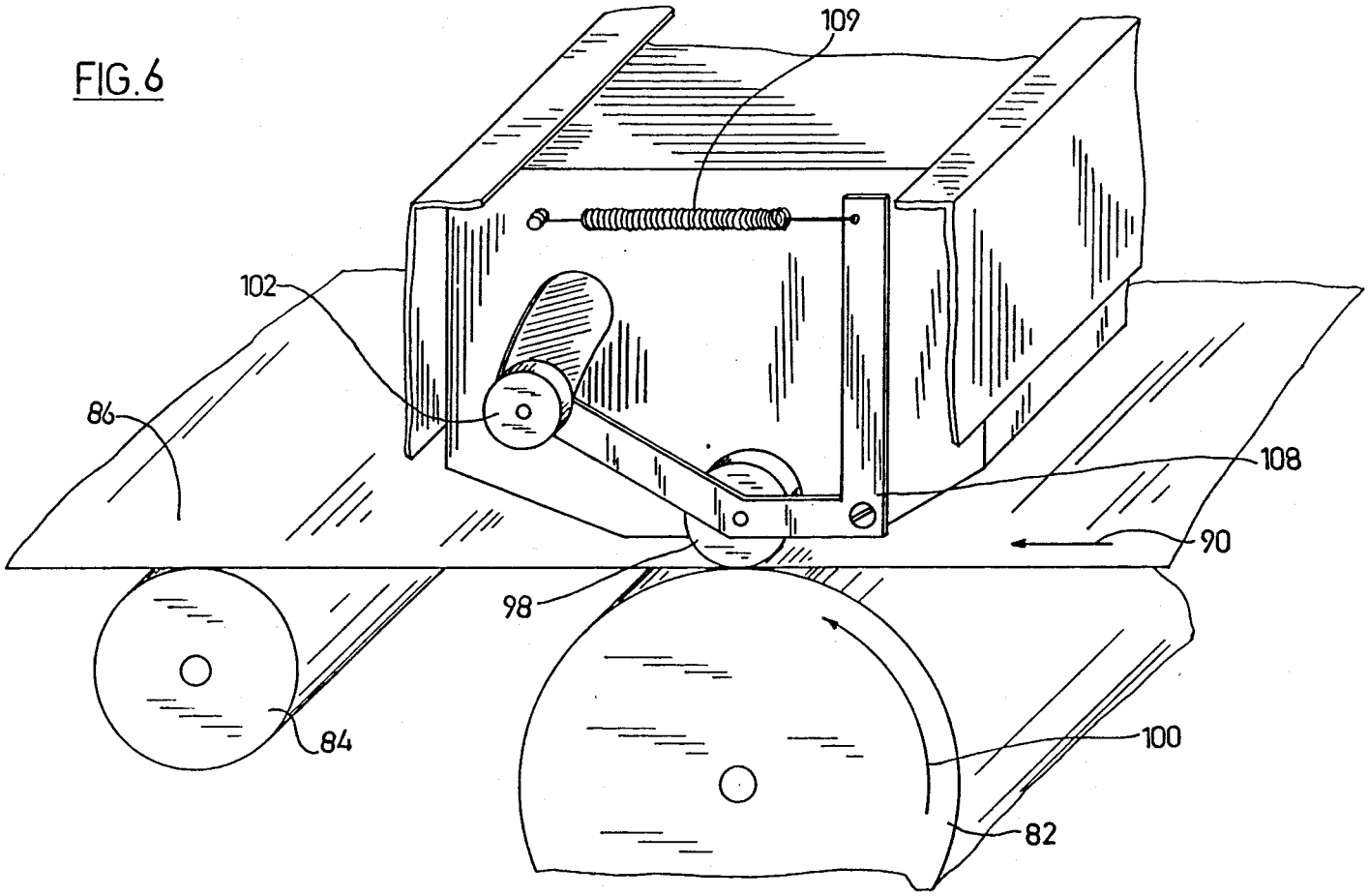
FIG. 6 is a pictorial illustration of part of the synchronized drive apparatus of FIGS. 5A–5C.

In accordance with a preferred embodiment of the present invention, linear driving of the flexible substrate 86 is provided by a driving mechanism which will now be described with additional reference to FIG. 6. Initial acceleration of the flexible substrate 86 and frame 88 in the direction indicated by arrow 90 is provided by extension of a solenoid driven piston 96. Further driving of the flexible substrate 86 is provided by frictional engagement of the substrate 86 between a friction roller 98 and the cylindrical edge surface of image bearing surface 82. This frictional engagement ensures that the linear travel of the substrate 86 precisely corresponds to the linear travel of the cylindrical image bearing surface 82, produced by rotation thereof in the direction indicated by arrow 100. The linear surface rotation of image receiving surface 84 is precisely synchronized with that of the image bearing surface 82 and thus with the linear travel of the substrate 86, by means of suitable gearing (not shown).

In order that engagement of friction roller 98 not interfere with sliding motion of the frame 88 and the substrate 86 when the substrate is not in image transfer engagement with either of surfaces 82 and 84, the friction roller 98 is spring mounted in association with a cam follower roller 102 by means of a linkage 108 and a spring 109.

It may be appreciated that at the onset of motion in the direction of arrow 90 and at the end of such motion, illustrated respectively in FIGS. 5A and 5C, roller 102 engages respective cams 104 and 106 which are mounted on frame 88, thus causing friction roller 98 to disengage from substrate 86.

Intermediate the two extremes illustrated in FIGS. 5A and 5C, the roller 102 does not engage the cams and thus the friction roller 98 is caused to engage substrate 86 causing drum 2 to drive it in synchronized travel with the surface travel of surfaces 82 and 84.

Reference is now made to FIGS. 7A–7E, which illustrate schematically a number of variations of the image transfer system described hereinabove in connection with FIGS. 5A–5C. Common reference numerals have been used throughout to indicate similar structures.

Figure 7A:
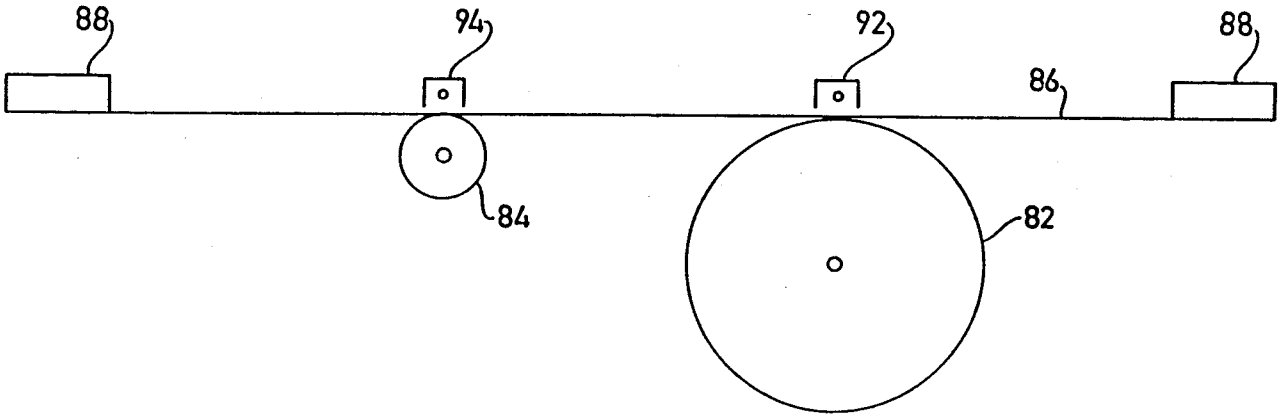
FIGS. 7A–7E are schematic side view illustrations of five variations of apparatus for printing on a curved substrate in accordance with preferred embodiments of the present invention.
Figure 7B:
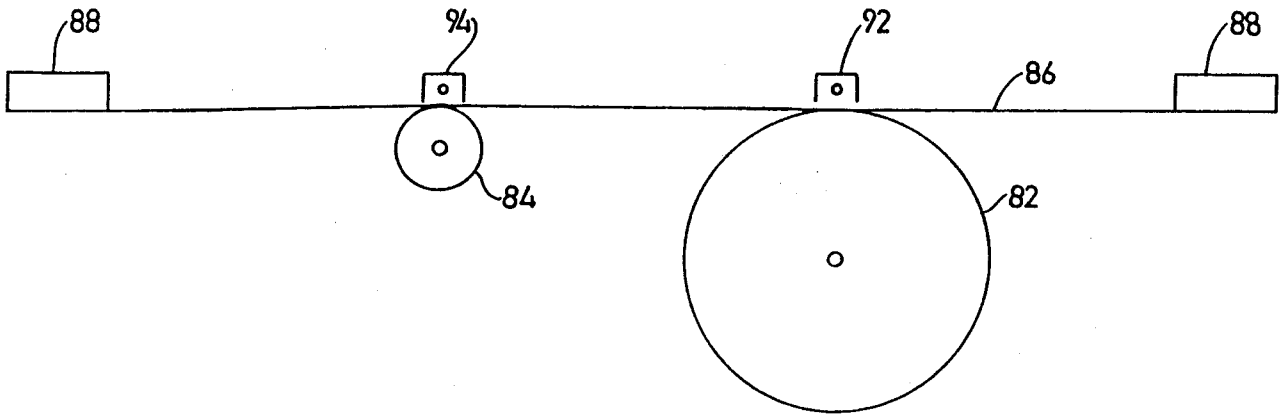

FIG. 7A illustrates the system of FIGS. 5A–5C generally wherein only line contact is provided between the substrate 86 and the image bearing surface 82 and between the same said substrate 86 and the image receiving surface 84 in the absence of the operation of the corotron, and relatively narrow area contact is produced by action of the corotron. FIG. 7B illustrates the same system wherein much broader area contact is provided with both the image bearing surface 82 and the image receiving surface 84 by suitable relative orientation of the surfaces relative to the substrate 86.

Figure 7C:
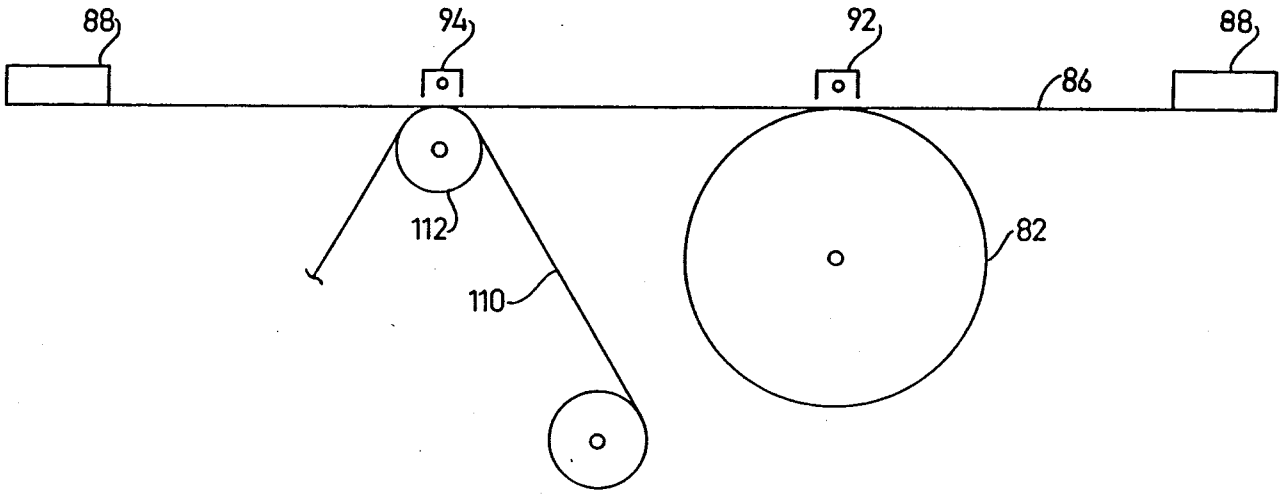
Figure 7D:
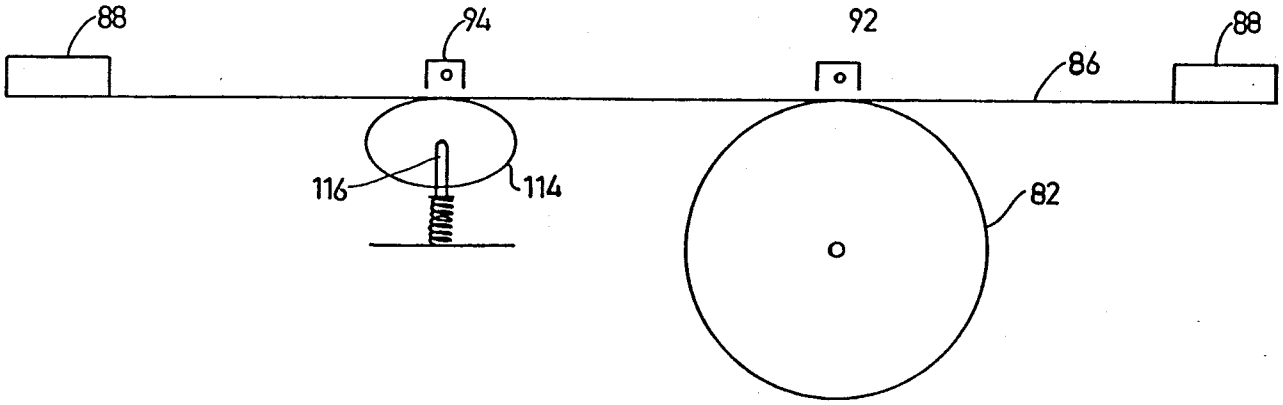

FIG. 7C illustrates an embodiment wherein a web of sheet material 110 is fed over a roller 112, to define a curved image receiving surface. FIG. 7D illustrates an image receiving cylinder 114 which has a non circular cross section and is supported by a spring loaded support 116. It is appreciated that the synchronization of the rotation drive of cylinder 114 must take into account the cross sectional configuration of the cylinder.

Figure 7E:
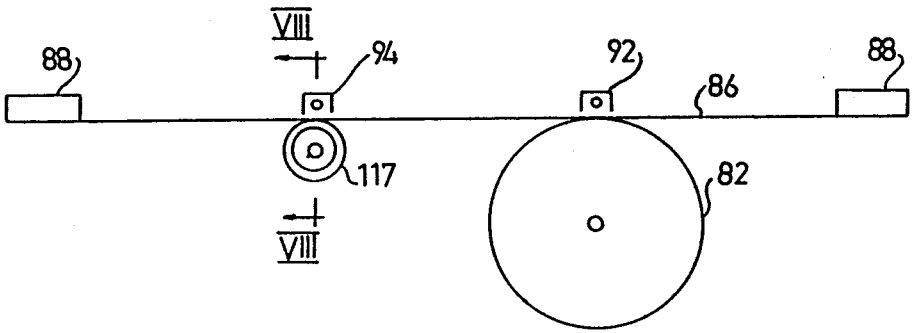
Figure 8:
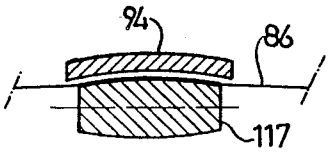
FIG. 8 is a sectional illustration of part of the apparatus of FIG. 7E, taken along the lines VIII—VIII in FIG. 7E.

FIGS. 7E and 8 illustrate an embodiment wherein a non-cylindrical image receiving surface 117 is provided and wherein the image receiving surface is curved in a direction perpendicular to the direction of travel. Here a suitably curved corotron 94 is employed as shown in FIG. 8.

It will be appreciated that in most applications, particularly those described above in connection with FIGS. 7A–7E, the flexible substrate will be wetted with a transfer liquid such as Isopar H, prior to entering transfer engagement with an image bearing surface.

The apparatus and techniques of the present invention may be used for a wide variety of applications including printing on smooth surfaces such as plastic surfaces, printing on curved surfaces such as metal cans and producing silk screen masters.

With the provision of a tensioned flexible substrate fixedly mounted on a rigid frame, the achievement of suitable alignment for precise registration of multi-pass color electrophotography, color proofing and other processes becomes a straightforward engineering task. Required color changes for electrophotography, for example, can be provided by sequentially draining and replacing toner in container 18 for successive colors as is well know in the art or, for both electrophotography and gravure, by the provision of multiple transfer drums 2 as is also well known in the art.

It will be appreciated by persons skilled in the art that the present invention is not limited to what has been particularly shown and described hereinabove. The scope of the invention is, rather, limited solely by the claims which follow:

We claim:

1. Imaging apparatus comprising:

an image bearing surface for receiving an image comprising charged toner particles;

a flexible substrate;

means for tensioning said flexible substrate in at least two directions;

means for bringing the tensioned flexible substrate into image transfer engagement with the image bearing surface; and means for generating an electric field in a region where image transfer engagement occurs to facilitate transfer of the image on said image bearing surface to said flexible substrate.

2. Imaging apparatus according to claim 1 including means for subsequently bringing the tensioned flexible substrate bearing said image into image transfer engagement with an image receiving surface for facilitating image transfer thereto.

3. Imaging apparatus for transferring an image to an image receiving surface comprising:

a flexible medium having an image bearing surface;

means for tensioning said flexible medium in at least two directions;

electrostatic means for producing an image comprising charged toner particles on said image bearing surface; and means bringing said image bearing surface into image transfer engagement with the image receiving surface.

4. Imaging apparatus according to claim 1 and wherein said means for bringing the tensioned flexible substrate into image transfer engagement produces motion of said flexible substrate and the image bearing surface in a travel direction and the at least two directions of tensioning include the general direction of travel and a direction generally transverse thereto in the plane along which the flexible substrate lies, when in image transfer engagement.

5. Imaging apparatus according to claim 3 and wherein said means for subsequently bringing produces motion of said flexible medium and the image bearing surface in a travel direction and the at least two directions of tensioning include the general direction of travel and a direction generally transverse thereto in the plane along which the flexible medium lies, when in image transfer engagement.

6. Imaging apparatus according to claim 1 and wherein said image bearing surface is a gravure cylinder.

7. Imaging apparatus according to claim 2 and wherein said image bearing surface is a gravure cylinder.

8. Imaging apparatus according to claim 1 and wherein said image bearing surface is a photoconductive surface.

9. Imaging apparatus according to claim 2 comprising means for generating an electrical field in the region where image transfer engagement occurs between the flexible substrate and the image receiving surface to facilitate image transfer therebetween.

10. Imaging apparatus according to claim 1 and wherein said means for tensioning is operative for supporting the flexible substrate in a generally planar orientation and contacts the flexible substrate only outside regions of image transfer engagement.

11. Imaging apparatus according to claim 3 and wherein said means for tensioning is operative for supporting the flexible medium in a generally planar orientation and contacts the flexible medium only outside regions of image transfer engagement.

12. Imaging apparatus according to claim 1 and wherein said means for bringing the tensioned flexible substrate into image transfer engagement with an image bearing surface includes means for providing synchronized motion of the image bearing surface and of the flexible substrate in image transfer engagement therewith to prevent relative sliding motion therebetween.

13. Imaging apparatus according to claim 12 and wherein said means for providing synchronized motion includes a friction engagement member which provides frictional contact between the flexible substrate and said image bearing surface for causing their surface travel to be synchronized.

14. Imaging apparatus according to claim 1 and wherein said image bearing surface comprises a generally cylindrical surface and said means for tensioning is operative for supporting said flexible substrate in a generally planar orientation in generally tangential orientation relative to the generally cylindrical surface during image transfer engagement.

15. Imaging apparatus according to claim 14 and wherein during image transfer engagement the flexible substrate is in generally curved surface contact with a portion of the cylindrical image bearing surface during image transfer engagement.

16. Imaging apparatus according to claim 1 and wherein said means for tensioning comprises a frame having an expandable element associated therewith along its periphery, whereby expansion of the expandable element provides tensioning of the flexible substrate mounted on the frame in at least two directions.

17. Imaging apparatus according to claim 3 and wherein said means for tensioning comprises a frame having an expandable element associated therewith along its periphery, whereby expansion of the expandable element provides tensioning of the flexible medium mounted on the frame in at least two directions.

18. Imaging apparatus according to claim 1 and wherein said means for tensioning comprises pressure rollers engaging said flexible substrate so as to apply pressure thereto during image transfer engagement.

19. Imaging apparatus according to claim 3 and wherein said means for tensioning comprises pressure rollers engaging said flexible medium so as to apply pressure thereto during image transfer engagement.

20. Imaging apparatus according to claim 3 and wherein said image receiving surface comprises a curved surface.

21. Imaging apparatus according to claim 20 and wherein said image receiving surface comprises a cylinder.

22. Imaging apparatus according to claim 20 and wherein said image receiving surface comprises a non-cylindrical surface, whose cross section varies in a direction transverse to the direction of travel of the flexible medium and the image receiving surface.

23. Imaging apparatus according to claim 21 and wherein said image receiving surface comprises a circular cylinder.

24. Imaging apparatus according to claim 21 and wherein said image receiving surface comprises a non-circular cylinder.

25. Imaging apparatus according to claim 21 and wherein said means for subsequently bringing the tensioned flexible medium bearing an image into image transfer engagement with the image receiving surface comprises spring loaded means for rotatably mounting the image receiving surface.

26. Imaging apparatus according to claim 20 wherein during transfer engagement the flexible medium is in generally curved surface contact with a portion of said curved surface.

27. Imaging apparatus according to claim 2 and wherein said image receiving surface comprises a cylinder.

28. Imaging apparatus according to claim 3 and wherein said image receiving surface comprises a non-cylindrical surface, whose cross section varies in a direction transverse to the direction of travel of the flexible substrate and the image receiving surface.

29. Imaging apparatus according to claim 27 and wherein said image receiving surface comprises a circular cylinder.

30. Imaging apparatus according to claim 27 and wherein said image receiving surface comprises a non-circular cylinder.

31. Imaging apparatus according to claim 30 and wherein said means for bringing comprises spring loaded means for rotatably mounting the image receiving surface.

32. A method for transfer of images from an image bearing surface onto a flexible substrate comprising the steps of:

producing an image comprising charged toner particles on the image bearing surface;

tensioning the flexible substrate in at least two directions; and bringing the tensioned flexible substrate into image transfer engagement with the image bearing surface; and providing an electric field in a region where image transfer engagement occurs to facilitate image transfer.

33. A method according to claim 32 and also comprising the step of subsequently bringing the tensioned flexible substrate bearing an image into image transfer engagement with an image receiving surface for transferring an image thereto.

34. A method for transfer of images from an image bearing surface of a flexible substrate to an image receiving surface comprising:

tensioning said flexible medium in at least two directions;

providing an image on said image bearing surface comprising charged toner particles; and subsequently bringing said image bearing surface into image transfer engagement with the image receiving surface.

35. A method according to claim 32 and wherein the step of bringing the tensioned flexible substrate into image transfer engagement includes the step of producing motion of the flexible substrate and the image bearing surface in a travel direction and the step of tensioning in at least two directions of tensioning includes the step of tensioning the flexible substrate in the general direction of travel and a direction generally transverse thereto in the plane along which the flexible substrate lies, when in image transfer engagement.

36. A method according to claim 34 and wherein the step of subsequently bringing the tensioned flexible medium into image transfer engagement includes the step of producing motion of the flexible substrate and the image bearing surface in a travel direction and the step of tensioning in at least two directions of tensioning includes the step of tensioning the flexible medium in the general direction of travel and a direction generally transverse thereto in the plane along which the flexible medium lies, when in image transfer engagement.

37. A method according to claim 33 comprising the steps of generating an electrical field in a region where image transfer engagement occurs between the flexible surface and the receiving surface to facilitate image transfer therebetween.

38. A method according to claim 32 and wherein the step of tensioning is operative for supporting the flexible substrate in a generally planar orientation and contacting the flexible substrate only outside a region of image transfer engagement.

39. A method according to claim 34 and wherein the step of tensioning is operative for supporting the flexible medium in a generally planar orientation and contacting the flexible medium only outside a region of image transfer engagement.

40. A method according to claim 32 and wherein said step of bringing the tensioned flexible substrate into image transfer engagement with an image bearing surface includes the step of providing synchronized motion of the image bearing surface and of the flexible substrate in image transfer engagement therewith to prevent relative sliding motion therebetween.

41. A method according to claim 32 wherein the image bearing surface comprises a generally cylindrical surface, and wherein the step of tensioning is operative for supporting the flexible substrate in a generally planar orientation in generally tangential orientation relative to the generally cylindrical surface during image transfer engagement.

42. A method according to claim 32 and wherein the step of tensioning comprises the steps of mounting the flexible substrate on a frame having an expandable element associated therewith along its periphery, and expanding the expandable element to provide tensioning of the flexible substrate mounted on the frame in at least two directions.

43. A method according to claim 34 and wherein said step of subsequently bringing includes the step of providing synchronized motion of the image bearing surface and of the image receiving surface in image transfer engagement therewith to prevent relative sliding motion therebetween.

44. A method according to claim 34 and wherein said image receiving surface comprises a curved surface and said step of tensioning is operative for supporting said flexible medium in a generally planar orientation in generally tangential orientation relative to the curved surface during image transfer engagement.

45. A method according to claim 44 and wherein during image transfer engagement the image bearing surface is in generally curved surface contact with a portion of the curved surface during image transfer engagement.

46. A method according to claim 44 and wherein said step of tensioning includes the step of providing a frame having an expandable element associated therewith along its periphery, whereby expansion of the expandable element provides tensioning of the flexible medium mounted on the frame in at least two directions.

47. Apparatus according to claim 1 wherein said image is a liquid toner image.

48. Apparatus according to claim 8 wherein said image is a liquid toner image.

49. Apparatus according to claim 9 wherein said image is a liquid toner image.

50. A method according to claim 32 wherein said image is a liquid toner image.

51. A method according to claim 34 wherein said image is a liquid toner image.

52. A method according to claim 37 wherein said image is a liquid toner image.

* * * * *